US009478323B2

(12) United States Patent
Okafuji et al.

(10) Patent No.: US 9,478,323 B2
(45) **Date of Patent: *Oct. 25, 2016**

(54) CU—SI—CO-BASED COPPER ALLOY FOR ELECTRONIC MATERIALS AND METHOD FOR PRODUCING THE SAME

(75) Inventors: Yasuhiro Okafuji, Ibaraki (JP); Hiroshi Kuwagaki, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 150 days.

This patent is subject to a terminal disclaimer.

(21) Appl. No.: 14/006,735

(22) PCT Filed: Mar. 2, 2012

(86) PCT No.: PCT/JP2012/055436

§ 371 (c)(1),
(2), (4) Date: Sep. 23, 2013

(87) PCT Pub. No.: WO2012/132765

PCT Pub. Date: Oct. 4, 2012

(65) Prior Publication Data

US 2014/0014240 A1 Jan. 16, 2014

(30) Foreign Application Priority Data

Mar. 28, 2011 (JP) ..... 2011-070685

(51) Int. Cl.
*C22C 9/06* (2006.01)
*H01B 1/02* (2006.01)
(Continued)

(52) U.S. Cl.
CPC ..... *H01B 1/026* (2013.01); *C22C 1/02* (2013.01); *C22C 9/06* (2013.01); *C22F 1/08* (2013.01)

(58) Field of Classification Search
CPC ..... C22C 9/06; C22C 9/10; C22F 1/00; C22F 1/08; H01B 1/026
USPC ..... 420/485–488, 490, 496; 148/554
See application file for complete search history.

(56) References Cited

U.S. PATENT DOCUMENTS 8,070,893 B2 12/2011 Era et al.
8,317,948 B2 11/2012 Era et al.
(Continued)

FOREIGN PATENT DOCUMENTS

CN 101168829 A 4/2008
CN 101646791 A 2/2010
(Continued)

OTHER PUBLICATIONS

Extended European Search Report for Application No. 12764206.4 dated Aug. 12, 2014.
(Continued)

*Primary Examiner* — Jessee Roe
*Assistant Examiner* — John Hevey
(74) *Attorney, Agent, or Firm* — Drinker Biddle & Reath LLP

(57) ABSTRACT

A Cu—Si—Co-based alloy having an enhanced spring limit is provided. The copper alloy comprises 0.5-2.5 mass % of Co, 0.1-0.7 mass % of Si, the balance Cu and inevitable impurities, wherein, from a result obtained from measurement of an X ray diffraction pole figure, using a rolled surface as a reference plane, a peak height at β angle of 90° among diffraction peaks in {111} Cu plane with respect to {200} Cu plane by β scanning at α=35° is at least 2.5 times that of a standard copper powder.

7 Claims, 3 Drawing Sheets

(51) Int. Cl.
*C22F 1/08* (2006.01)
*C22C 1/02* (2006.01)

(56) References Cited

U.S. PATENT DOCUMENTS

| | | | | |
|---|---|---|---|---|
| 8,444,779 | B2 | 5/2013 | Era et al. | |
| 2004/0079456 | A1 | 4/2004 | Mandigo et al. | |
| 2007/0062619 | A1* | 3/2007 | Maehara et al. | 148/554 |
| 2008/0056930 | A1 | 3/2008 | Ito et al. | 420/477 |
| 2008/0099110 | A1 | 5/2008 | Muroga et al. | |
| 2009/0165899 | A1 | 7/2009 | Sakai et al. | 148/501 |
| 2010/0170595 | A1 | 7/2010 | Kaneko et al. | |
| 2010/0326573 | A1 | 12/2010 | Mihara et al. | |
| 2011/0027122 | A1 | 2/2011 | Era et al. | |
| 2011/0186192 | A1 | 8/2011 | Mihara et al. | |
| 2011/0240182 | A1 | 10/2011 | Kuwagaki | |
| 2011/0244260 | A1 | 10/2011 | Kuwagaki | |
| 2012/0031533 | A1 | 2/2012 | Onda et al. | |
| 2013/0022492 | A1* | 1/2013 | Kuwagaki | 420/473 |
| 2013/0087255 | A1 | 4/2013 | Kuwagaki | |
| 2013/0263978 | A1* | 10/2013 | Kuwagaki | 148/554 |
| 2014/0014240 | A1 | 1/2014 | Okafuji et al. | |
| 2014/0014241 | A1* | 1/2014 | Kuwagaki et al. | 148/554 |

FOREIGN PATENT DOCUMENTS

| | | | |
|---|---|---|---|
| CN | 101680056 | A | 3/2010 |
| CN | 101952465 | A | 1/2011 |
| EP | 2042613 | | 4/2009 |
| JP | 07011363 | A | 1/1995 |
| JP | 2005-532477 | A | 10/2005 |
| JP | 2006-283059 | A | 10/2006 |
| JP | 2007-092135 | A | 4/2007 |
| JP | 2007-169765 | A | 7/2007 |
| JP | 2008-013836 | A | 1/2008 |
| JP | 2008056977 | A | 3/2008 |
| JP | 2008-106312 | A | 5/2008 |
| JP | 2008-106313 | A | 5/2008 |
| JP | 2009-242890 | A | 10/2009 |
| JP | 2009-242921 | A | 10/2009 |
| JP | 2010-215976 | A | 9/2010 |
| JP | 2010236071 | A | 10/2010 |
| JP | 2011-214088 | A | 10/2011 |
| JP | 2011-252209 | A | 12/2011 |
| TW | 201003674 | A | 1/2010 |
| WO | 2004/005560 | A2 | 1/2004 |
| WO | 2007148712 | A1 | 12/2007 |
| WO | 2010013790 | A1 | 2/2010 |
| WO | 2010064547 | A1 | 6/2010 |
| WO | 2010113553 | A1 | 10/2010 |

OTHER PUBLICATIONS

Office Action for U.S. Appl. No. 14/008,035 dated Apr. 22, 2015.
Office Action for U.S. Appl. No. 14/008,035 dated Jul. 8, 2015.
Office Action for U.S. Appl. No. 14/008,035 dated Dec. 16, 2015.
Office Action for U.S. Appl. No. 13/638,431 dated Jan. 12, 2015.
Office Action for U.S. Appl. No. 13/638,431 dated Jun. 25, 2015.
Office Action for U.S. Appl. No. 13/638,431 dated Dec. 16, 2015.
Office Action for U.S. Appl. No. 13/993,648 dated Apr. 22, 2015.
Office Action for U.S. Appl. No. 13/993,648 dated Jun. 26, 2015.
Office Action for U.S. Appl. No. 13/993,648 dated Dec. 15, 2015.

* cited by examiner

CU—SI—CO-BASED COPPER ALLOY FOR ELECTRONIC MATERIALS AND METHOD FOR PRODUCING THE SAME

TECHNICAL FIELD

The present invention relates to a precipitation-hardened copper alloy, and more particularly to a Cu—Si—Co-based copper alloy which can be advantageously used in various electronic components.

TECHNICAL BACKGROUND

Copper alloys for electronic materials used in various electronic components such as connectors, switches, relays, pins, terminals, lead frames and the like are required to satisfy both of high strength and high electrical conductivity (or thermal conductivity) as fundamental properties. In recent years, high integration, miniaturization and reduction of thickness of electronic components are rapidly progressing and correspondingly the requested level for the copper alloys used in the components for these electronic devices has been becoming higher and higher.

From the aspects of high strength and high electrical conductivity, the use of precipitation-hardened copper alloy as copper alloy for electronic materials is increasing in amount, in place of the conventional solid solution-strengthened type alloys represented by phosphor bronze, brass or the like. With respect to the precipitation-hardened copper alloy, a supersaturated solid solution, which has been subjected to solution treatment, is subjected to ageing treatment, whereby fine precipitates are homogeneously dispersed and not only the strength but also the electrical conductivity of the alloy are increased, because of the decreased amount of solid solution elements in the copper. For this reason, a material which excels not only in the mechanical strength of the alloy such as strength and resilience but also in the electrical conductivity and thermal conductivity can be obtained.

Among the precipitation-hardened copper alloys, Cu—Ni—Si-based copper alloy (generally called Corson alloy), is one of typical copper alloys which have a relatively high electrical conductivity, a high mechanical strength and a high bending workability and is currently being actively developed in the industries concerned. With this copper alloy, the strength and the electrical conductivity are both improved by precipitating fine particles of Ni—Si-based intermetallic compound in the copper matrix.

Recently, an attempt of improving the properties of Cu—Si—Co-based copper alloy instead of the Cu—Ni—Si-based copper alloy is underway. For example, Japanese Patent Application Publication No. 2010-236071 (Patent Literature 1) discloses, for the purpose of obtaining a Cu—Si—Co-based alloy having superior mechanical and electrical properties as well as mechanical homogeneity, a copper alloy containing 0.5-4.0 mass % of Co, 0.1-1.2 mass % of Si and the balance Cu and unavoidable impurities, wherein the average grain size is 15-30 μm, and the average difference between the maximum grain size and the minimum grain size per each field of view of 0.5 $mm^2$ is 10 μm or less.

The process of producing copper alloy disclosed in the patent document comprises the following sequential steps:

step 1 of melt-casting an ingot having a desired composition;

step 2 of heating the ingot to 950-1050° C. for at least one hour and thereafter subjecting it to hot rolling, setting the temperature at the time of completion of the hot rolling to at least 850° C., and cooling it from 850° C. to 400° C. at an average cooling rate of at least 15° C./sec;

step 3 of cold rolling with a working ratio of at least 70%;

step 4 of aging treatment at 350-500° C. for 1-24 hours;

step 5 of performing solution treatment at 950-1050° C., and then cooling the material temperature with an average cooling rate of at least 15° C./sec from 850° C. to 400° C.;

optional step 6 of cold rolling;

step 7 of ageing treatment; and optional step 8 of cold rolling.

PRIOR ART LITERATURE

Patent Literature

Japanese Patent Application Publication No. 2010-236071

SUMMARY OF THE INVENTION

Problem to be Solved by the Invention

Although the copper alloy described in Patent literature 1 provides a Cu—Si—Co-based alloy for electronic materials having superior mechanical and electrical properties, there is still room for improving the spring limit. Accordingly, one object of the present invention is to provide a Cu—Si—Co-based alloy having an improved spring limit. Another object of the present invention is to provide a method of producing such Cu—Si—Co-based alloy.

Means for Solving the Problem

In order to solve the problems, the inventors have conducted extensive studies and have discovered that, when the multi-step aging treatment after the solution treatment is performed in three stages under specific temperature and time conditions, the spring limit is significantly improved in addition to the strength and the conductivity. The inventors conducted a study seeking for the reason for this result and have found a singularity that the peak height at β angle of 90° among the diffraction peaks in the {111} Cu plane which has a positional relation of 55° (α=35° under the measurement condition) with respect to the {200} Cu plane on the rolled surface is at least 2.5 times the peak height of the copper powder. Although the reason why such diffraction peak was obtained is not clear, it is considered that the delicate distribution of the second-phase particles has exerted the influence.

The present invention completed based on this discovery provides, in one aspect, a copper alloy for electronic materials, which comprises 0.5-2.5 mass % of Co, 0.1-0.7 mass % of Si, the balance Cu and inevitable impurities, wherein, from a result obtained from measurement of an X ray diffraction pole figure, using a rolled surface as a reference plane, a peak height at β angle of 90° among diffraction peaks in {111} Cu plane with respect to {200} Cu plane by β scanning at α=35° is at least 2.5 times that of a standard copper powder.

In one embodiment of the present invention, the copper alloy according to the present invention satisfies the following formulae.

$$-55\times(\text{Co concentration})^2+250\times(\text{Co concentration})+520\geq YS\geq-55\times\text{Co concentration})^2+250\times(\text{Co concentration})+370, \text{ and} \quad \text{Formula a:}$$

$$60\times(\text{Co concentration})+400\geq Kb\geq60\times(\text{Co concentration})+275. \quad \text{Formula b:}$$

(In these formulae, a unit of Co concentration is mass %, YS is 0.2% yield strength and Kb is spring limit.)

In another embodiment of the present invention, the copper alloy according to the present invention satisfies the following relationship:

YS is at least 500 MPa, and Kb and YS satisfy the following relationship.

$$0.43\times YS+215\geq Kb\geq 0.23\times YS+215. \quad \text{Formula c:}$$

(In this formula, YS is 0.2% yield strength, and Kb is spring limit)

The copper alloy according to a further embodiment of the present invention wherein Co to Si mass concentration ratio (Co/Si) satisfies the relationship:

$$3\leq Co/Si\leq 5.$$

The copper alloy according to a yet further embodiment of the present invention further contains less than 1.0 mass % of Ni.

The copper alloy according to a yet further embodiment of the present invention contains at most 2.0 mass % in total of at least one selected from the group consisting of Cr, Mg, P, As, Sb, Be, B, Mn, Sn, Ti, Zr, Al, Fe, Zn, and Ag.

According to another aspect of the present invention, the present invention provides a method for producing a copper alloy, which comprises steps in the following sequence:

step 1 of melting and casting an ingot of copper alloy having any one of the above-mentioned compositions;

step 2 of heating the ingot at 900° C.-1050° C. for at least 1 hour, and thereafter subjecting it to a hot rolling;

step 3 of cold rolling;

step 4 of conducting solution treatment at 850-1050° C. and then cooling with an average cooling rate to 400° C. of at least 10° C./sec;

first aging step 5 comprising three stage aging, namely a first stage of heating the material at 480° C.-580° C. for 1-12 hours, then a second stage of heating the material at 430-530° C. for 1-12 hours, and then a third stage of heating the material at 300-430° C. for 4-30 hours, wherein the cooling rates from the first stage to the second stage and from the second stage to the third stage are at least 0.1° C./min respectively, and the temperature difference between the first stage and the second stage is 20-80° C. and the temperature difference between the second stage to the third stage is 20-180° C.;

step 6 of cold rolling; and second aging step 7 of heating to at least 100° C. but less than 350° C. for 1-48 hours.

The method for producing copper alloy according to the present invention further includes, in one embodiment, a pickling and/or a grinding step 8 after the step 7.

In a further aspect, the present invention provides a wrought copper product made of a copper alloy of the present invention.

In a further aspect, the present invention provides an electronic component provided with the copper alloy according to the present invention.

Effect of the Present Invention

According to the present invention, a Cu—Si—Co alloy for electronic materials superior in strength, conductivity and spring limit is provided.

MODES OF PRACTICING THE INVENTION

Addition Amount of Co and Si

Figure 1:
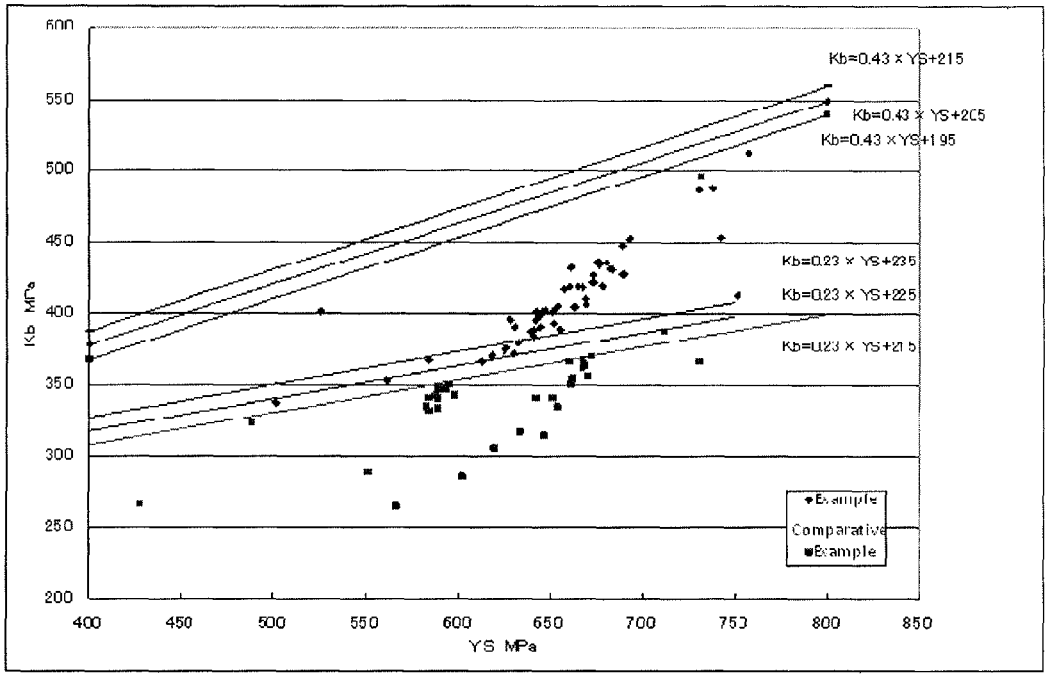
FIG. 1 is a graph wherein the examples and comparative examples are plotted with YS as the x axis and Kb as the y axis.

Co and Si form an intermetallic compound by subjecting them to an appropriate heat treatment, whereby the strength is enhanced without deteriorating the electrical conductivity.

If the addition amounts of Co and Si are such that Co is less than 0.5 mass % or Si is less than 0.1 mass %, the desired strength is not obtained. On the other hand, if Co is more than 2.5 mass % or Si is more than 0.7 mass %, not only the effect of the increase in the strength is saturated but also the bending workability and hot workability are deteriorated. Accordingly, preferable quantities to be added of Co and Si are Co:0.5-2.5 mass % and Si:0.1-0.7 mass %, respectively. More preferable added quantities of Co and Si are Co:1.0-2.0 mass % and Si:0.2-0.6 mass %, respectively.

Further, if the ratio Co/Si of mass concentrations of Co to Si is too low, or Si to Co is excessively high, the electrical conductivity is lowered due to the Si solid solution, or the soldering property is lowered due to formation of an oxide film of $SiO_2$ on the surface of a material during annealing step. On the other hand, if the ratio of Co to Si is too high, Si for forming silicide becomes insufficient, thereby making it difficult to obtain a high strength.

Accordingly, it is preferable to control the ratio Co/Si in the alloy composition in the range of $3\leq Co/Si\leq 5$, and more preferably $3.7\leq Co/Si\leq 4.7$.

Addition Amount of Ni

Ni re-forms a solid solution by solution treatment or the like, and forms an intermetallic compound with Si during subsequent aging precipitation, so as to enhance the strength with little losing the electrical conductivity. However, when the Ni concentration is 1.0 mass % or more, Ni which could not be precipitated by aging forms a solid solution in the matrix phase, thereby lowering the electrical conductivity. Accordingly, Ni can be added at less than 1.0 mass % to the Cu—Si—Co-based alloy according to the present invention. Less than 0.03 mass % is not very effective and accordingly addition of at least 0.03 mass % but less than 1.0 mass %, more preferably 0.09-0.5 mass % is recommended.

Addition Amount of Cr

Cr can strengthen grain boundary because Cr is preferentially precipitated in the grain boundary area during the cooling process at the time of casting, so that generation of cracking during the hot working is suppressed and the lowering in the yield ratio is suppressed. In other words, although the Cr precipitated in the boundary during the casting process forms solid solution again by the solution treatment, but during the subsequent aging precipitation, deposited particles of a bcc structure consisting mainly of Cr or compounds with Si are formed. Among the quantity of the added Si, the Si that did not contribute to the aging precipitation remains as solid solution in the matrix phase and restricts the increase in the electrical conductivity. However, by adding Cr, which is an element capable of forming silicate, silicate is further precipitated to decrease the amount of the Si solid solution, whereby the electrical conductivity can be increased without lowering the strength. However, when the Cr concentration exceeds 0.5 mass %, more specifically 2.0 mass %, coarse second-phase particles tend to be formed and the quality of the product will be impaired. Accordingly, Cr may be added to the Cu—Si—Co-based alloy of the present invention in an amount of 2.0 mass % at most. As the amount of less than 0.03 mass % is too small to attain its effect, preferably 0.03-0.5 mass %, more preferably 0.09-0.3 mass %, are added.

Addition Amount of Mg, Mn, Ag and P

Addition of a very small amount of Mg, Mn, Ag and P improves the product properties such as strength, stress relaxation property without impairing the electrical conductivity. The effectiveness of the addition is mainly achieved by the formation of solid solution in the matrix phase but its inclusion into the second-phase particles can further enhance the effectiveness. However, when the total concentration of Mg, Mn, Ag and P exceeds 0.5 mass %, more particularly 2.0 mass %, the effect of improvement of the properties is saturated and the productivity is impaired. Accordingly, one or more selected from Mg, Mn, Ag and P can be added to the Cu—Si—Co-based alloy of the present invention at the total concentration of 2.0 mass % at most, preferably 1.5 mass % at most. However, the effectiveness is slight at less than 0.01 mass % and accordingly the preferred amount is 0.01-1.0 mass %, and more preferably 0.04-0.5 mass % in total.

Addition Amount of Sn and Zn

Also, addition of a slight amount of Sn and Zn improves the product properties such as strength, stress relaxation property, plating property, etc. without impairing the electrical conductivity. The effectiveness by the addition is mainly obtained by the solid solution into the matrix phase. However, if the total quantity of Sn and Zn exceeds 2.0 mass %, the effectiveness for the improvement of the properties is saturated and impairs the productivity. Accordingly, at least one of Sn and Zn may be added to the Cu—Si—Co-based alloy of the present invention in a total quantity of 2.0 mass % at the maximum. However, since the effectiveness is slight at less than 0.05 mass %, preferably 0.05-2.0 mass %, more preferably 0.5-1.0 mass % is added in total.

Addition Amount of As, Sb, Be, B, Ti, Zr, Al and Fe

Also, with respect to As, Sb, Be, B, Ti, Zr, Al and Fe, by adjusting their total amount of addition depending on the required product properties, the product properties such as electrical conductivity, strength, stress relaxation property, plating property are improved. The effectiveness of the addition is mainly achieved by their solid solution into the matrix phase but their inclusion into the second-phase particles or formation of new second-phase particles can further enhance the effectiveness. However, if the total quantity of these elements exceeds 2.0 mass %, the effectiveness for the improvement of the properties is saturated and impairs the productivity. Accordingly, at least one selected from As, Sb, Be, B, Ti, Zr, Al and Fe can be added to the Cu—Si—Co-based alloy in a quantity of up to 2.0 mass % in total. However, less than 0.001 mass % has little effect and accordingly 0.001-2.0 mass %, more preferably 0.05-1.0 mass % in total is added.

If a total addition amount of the above-mentioned Ni, Cr, Mg, P, As, Sb, Be, B, Mn, Sn, Ti, Zr, Al, Fe, Zn and Ag exceeds 2.0 mass %, the productivity tends to be impaired. Accordingly, the total quantity of these elements is 2.0 mass % or less and more preferably 1.5 mass % or less.

Crystal Orientation

The copper alloy according to the present invention, from the result obtained from measurement of an X ray diffraction pole figure, has a ratio of the peak height at β angle of 90° among diffraction peaks in {111} Cu plane with respect to {200} Cu plane by β scanning at α=35° to the peak height of the standard copper powder (hereinafter called "the ratio of the peak height at β angle of 90°") is at least 2.5 times. Although the reason why the spring limit is increased by controlling the ratio of the peak height at β angle of 90° among diffraction peaks in {111} Cu is not clear, it is presumed that, by the three stage aging in the first aging treatment, the growth of the second-phase particles precipitated in the first and second stage as well as the second-phase particles precipitated in the third stage make it easy to build up work strain in the next rolling step. Using this built-up strain as a driving force, the aggregate structure is developed in the second aging stage.

The ratio of the peak height at β angle of 90° is preferably at least 2.8 times, more preferably at least 3.0 times. The pure standard copper powder is defined by the copper powder with purity 99.5% of 325 mesh (JIS Z 8801).

The peak height at β angle of 90° among diffraction peaks in {111} Cu plane is measured according to the following procedure called "pole figure measurement". Taking one of the diffraction {hkl} Cu planes, a stepwise α-axis scanning is performed with respect to the value 2θ of the {hkl} Cu plane concerned (the scanning angle 2θ of the detector is fixed), and the specimen is subjected to β axis scanning (0 to 360° in-plane rotation (axial rotation)) for the angle α. In the XRD pole figure measurement in the present invention, the direction normal to the surface of the specimen is defined as α90° which is used as the reference of measurement. Also, the pole figure measurement is carried out by the reflection method (α: from −15° to 90°). In the present invention, the intensity for the β angle at α=35° is plotted and the highest intensity in the range β=85°-95° is read as the peak value at 90°.

Properties

The copper alloy according to one embodiment of the present invention satisfies the following formulae.

$$-55\times(\text{Co concentration})^2+250\times(\text{Co concentration})+520\geq YS\geq-55\times\text{Co concentration})^2+250\times(\text{Co concentration})+370,\ \text{and} \qquad \text{Formula a:}$$

$$60\times(\text{Co concentration})+400\geq Kb\geq60\times(\text{Co concentration})+275. \qquad \text{Formula b:}$$

(In the formulae, the unit of the Co concentration is mass %, YS is 0.2% yield strength, and Kb is spring limit.)

In one preferable embodiment of the copper alloy according to the present invention, it satisfies the following formulae.

$$-55\times(\text{Co concentration})^2+250\times(\text{Co concentration})+500\geq YS\geq-55\times(\text{Co concentration})^2+250\times(\text{Co concentration})+380,\ \text{and} \qquad \text{Formula a':}$$

$$60\times(\text{Co concentration})+390\geq Kb\geq60\times(\text{Co concentration})+285 \qquad \text{Formula b':}$$

More preferably, $$-55\times(\text{Co concentration})^2+250\times(\text{Co concentration})\pm490\geq YS\geq-55\times(\text{Co concentration})^2+250\times(\text{Co concentration})+390 \qquad \text{Formula a'':}$$

$$60\times(\text{Co concentration})+380\geq Kb\geq60\times(\text{Co concentration})+295 \qquad \text{Formula b'':}$$

(In the formulae, the unit of the Co concentration is mass %, YS is 0.2% yield strength, and Kb is spring limit.)

In one embodiment of the copper alloy according to the present invention, YS is at least 500 MPa, and Kb and YS satisfy the following formula.

$$0.43\times YS+215\geq Kb\geq0.23\times YS+215 \qquad \text{Formula c:}$$

(In the formulae, YS is 0.2% yield strength, and Kb is spring limit.)

In one preferred embodiment of the copper alloy according to the present invention, YS is at least 500 MPa and the relation between Kb and YS satisfies the following formulae.

$$0.43\times YS+205\geq Kb\geq 0.23\times YS+225 \quad \text{Formula c':}$$

More preferably, $$0.43\times YS+195\geq Kb\geq 0.23\times YS+235 \quad \text{Formula c'':}$$

(In the formulae, YS is 0.2% yield strength, and Kb is spring limit.)

In one embodiment according to the present invention, YS is 500-800 MPa, and typically 600-760 MPa.

Method of Production

In a general method of producing Corson copper alloy, firstly an atmospheric melting furnace is used to melt electrolytic cathode copper, Si, Co and other raw materials to obtain a molten metal of a desired composition. This molten metal is casted into an ingot. Thereafter, the ingot is subjected to hot rolling, and then cold rolling and heat treatment are repeated, thereby obtaining a strip or a foil of desired thickness and properties. The heat treatment includes solution treatment and aging treatment. In the solution treatment, the material is heated to a high temperature of about 700 to about 1050° to solve the second-phase particles into the Cu matrix to form a solid solution and at the same time the Cu matrix is re-crystallized. Hot rolling sometimes doubles as the solution treatment. In the aging treatment, the material is heated for 1 hour or more in a temperature range of about 350 to about 600° C., and second-phase particles formed into a solid solution in the solution treatment are precipitated as microparticles on a nanometer order. The aging treatment results in increased strength and electrical conductivity. Cold rolling is sometimes performed before and/or after the aging treatment in order to obtain higher strength. Also, stress relief annealing (low-temperature annealing) is sometimes performed after cold rolling in case where cold rolling is carried out after aging.

Grinding, polishing, shot blast, pickling, and the like may be carried out as needed in order to remove oxidized scale on the surface between each of the above-described steps.

The copper alloy according to the present invention, too, experiences these production processes, but in order to obtain the final copper alloy having properties within the ranges as defined by the present invention, it is essential that the hot rolling, the solution treatment and the aging treatment are carried out under strictly controlled conditions. This is because, in the Cu—Co—Si-based alloy of the present invention, unlike the conventional Cu—Ni—Si-based Corson alloy, the element Co, which is difficult to control the second-phase particles, is positively added as an essential component for the aging precipitation hardening. This is because Co forms the second-phase particles together with Si, but its formation and growth rate are sensitive to the retention temperature and cooling rate.

First of all, as it is unavoidable that coarse crystallites are formed during the solidification in the casting step and coarse precipitates are formed during the cooling step, it is necessary in the succeeding step to solve the second-phase particles into the matrix phase. Co can form solid solution in the matrix phase by retaining the material at 900-1050° C. for at least one hour and then subjecting it to hot rolling. The temperature condition of at least 900° C. is higher than the other Corson alloys. If the retention temperature is less than 900° C., the solid solution is not sufficiently formed. At the temperature condition above 1050° C., there is a possibility of melting the material. It is also desirable to quench the material swiftly after the completion of the hot rolling.

The solution treatment has the objects of dissolving the crystallites formed at the time of the casting and the precipitated particles after hot rolling into the solid solution, thereby enhancing the age hardening ability after the hot rolling. In this treatment, the retention temperature and time, and the quenching rate after the retention become important. If the retention time is fixed, the crystallites formed at the time of casting and the precipitated particles after the hot rolling can be solved into the solid solution at a higher retention temperature.

The grater the cooling rate is after the solution treatment, the more the precipitation can be suppressed during the cooling process. If the cooling rate is too slow, coarser second-phase particles will grow during the cooling process and thus the Co and Si contents will increase in the second-phase particles, whereby a sufficient solid solution will not be attained by the solution treatment and the age hardening capability will decrease. Therefore, the cooling after the solution treatment is preferably a quenching. More specifically, following the solution treatment at 850° C.-1050° C., a cooling process is conducted at an average cooling rate of at least 10° C./sec, preferably at least 15° C./sec, more preferably at least 20° C./sec, down to a temperature of 400° C. There is no particular upper limit but the upper limit is 100° C./sec or less according to the specification of the facility. Here, the "average cooling rate" means the value (° C./sec) determined by measuring the cooling time from the temperature of the solution treatment to 400° C. and calculating the value $$(°\,C./sec)=(\text{temperature of solution treatment}-400)(°\,C.)/\text{cooling time (sec)}.$$

In manufacturing Cu—Co—Si-based alloys according to the present invention, it was found effective when two step aging treatments after the solution treatment are lightly carried out and a cold rolling step is carried out between these aging steps. As a result, the formation of coarse precipitates is suppressed and a good distribution of the second-phase particles can be obtained. This finally leads to the crystal orientation unique to the copper alloy according to the present invention.

The inventors of the present invention have found that, when the first aging treatment immediately after the solution treatment is conducted by three stage aging in the following specific conditions, the spring limit is markedly enhanced. Although it is known by literatures that a multiple stage aging improves the balance between strength and conductivity, it is surprising that the spring limit has also been remarkably improved by strictly controlling the number of steps of the multiple aging, temperature, time period and cooling rate. According to the experiments by the present inventors, such result could not be achieved by one stage aging treatment, nor by two stage aging treatment. In addition, sufficient effect was not obtained when the three stage aging treatment was conducted only in the second aging treatment.

Although not intended to be restricted by any theory, it is considered that the reason why the three stage aging has remarkably improved the spring limit is that, by adopting the three stage aging in the first aging treatment, the growth of the second-phase particles precipitated in the first and second stage as well as the precipitation of the secondary particles in the third stage preclude the aggregate structure from developing in the subsequent rolling step.

In the three stage aging, the first stage is conducted by heating the material at 480-580° C. for 1-12 hours. The first stage aims at enhancing strength and electrical conductivity by the nucleation and growth of the second-phase particles.

If the temperature of the material is lower than 480° C. or the heating time is less than 1 hour in the first stage, the volume fraction of the second-phase particles is too small to obtain the desired strength and electrical conductivity. On the other hand, if the heating is conducted until the temperature of the material exceeds 580° C. or the heating time exceeds 12 hours, the volume fraction of the second-phase particles becomes large but there is a growing tendency to decrease strength due to coarsening.

After completion of the first stage, the process is switched over to the aging temperature for the second stage by setting the cooling rate at 0.1° C./min or more. The reason why the cooling rate is set at this value is to avoid excessive growth of the second-phase particles which were precipitated in the first stage. If the cooling rate is too rapid, the undershooting becomes too large and accordingly 100° C./min or less is preferable. The cooling rate here is measured by (first stage aging temperature−second stage aging temperature)(° C.)/(cooling time (min) from the first stage aging temperature to the arrival at the second stage aging temperature).

Then, the second stage is carried out at the material temperature of 430-530° C. for 1-12 hours. The second stage is for enhancing electrical conductivity by growing the second-phase particles precipitated in the first stage to the extent they can contribute to strength, and for obtaining higher strength and electrical conductivity by causing precipitation of the fresh second-phase particles (smaller than the second-phase particles precipitated in the first stage).

If the temperature of the material in the second stage is less than 430° C. or the heating time is less than 1 hour, the second-phase particles precipitated in the first stage will little grow and accordingly it is difficult to increase electrical conductivity. Also, in the second stage the second-phase particles will not be newly precipitated and accordingly it is difficult to increase strength and electrical conductivity. On the other hand, if the temperature of the material exceeds 530° C. or the heating time exceeds 12 hours, the second-phase particles precipitated in the first stage will excessively grow to become coarse, impairing strength.

If the temperature difference between the first and second stages is too small, the second-phase particles precipitated in the first stage will become coarse and cause reduction of strength, while if the difference is too large, the second-phase particles precipitated in the first stage will little grow and electrical conductivity cannot be improved. Also, in the second stage second-phase particles are difficult to precipitate, strength and electrical conductivity cannot be increased. For these reasons, the temperature difference between the first and second stages should be 20-80° C.

After finishing the second stage, for the same reason as mentioned earlier, the cooling rate is set at 0.1° C./min or more and the process is switched over to the third stage aging temperature. Similarly to the shift from the first stage to the second stage, the cooling rate is preferably 100° C./min or less. The cooling rate here is measured by (second stage aging temperature−third stage aging temperature)(° C.)/(cooling time (min) from the second stage aging temperature to the arrival at the third stage aging temperature).

Next, the third stage is conducted at the material temperature of 300-430° C. for 4-30 hours. The third stage is for growing a little the second-phase particles precipitated in the first and second stages and for generating fresh second-phase particles.

If the temperature of the material in the third stage is less than 300° C. or the heating time is less than 4 hours, it will not be possible to make the second-phase particles precipitated in the first and second stages grow or to generate fresh second-phase particles. Accordingly it is difficult to obtain a desired strength, electrical conductivity and spring limit. On the other hand, if the heating is conducted until the temperature of material exceeds 430° C. or the heating time exceeds 30 hours, the second-phase particles precipitated in the first and second stages will excessively grow to become coarse and thus desired strength and spring limit are difficult to achieve.

If the temperature difference between the second and the third stages is too small, the second-phase particles precipitated in the first and second stages will excessively grow, causing lower strength and spring limit, while if the difference is too large, the second-phase particles formed in the first and second stages will little grow and electrical conductivity cannot be improved. Also, second-phase particles are difficult to be precipitated in the third stage, strength, spring limit and electrical conductivity cannot be enhanced. For these reasons, the temperature difference between the second and third stages should be 20-180° C.

In a single aging treatment stage, the temperature should be kept constant as a rule since the distribution of the second-phase particles might be changed. However, fluctuation of ±5° C. from the setting temperature is allowable. Accordingly, each stage is conducted within a temperature fluctuation of 10° C.

After the first aging, cold rolling is performed. In this cold rolling, the insufficient age-hardening in the first aging treatment can be supplemented by the work hardening. The working ratio is 10-80%, preferably 15-50%, to attain the desired level of strength. However, the spring limit will be reduced. Further, the fine particles precipitated in the first aging treatment are sheared by dislocation and reform solid solution, resulting in decrease of electrical conductivity.

After the cold rolling, it is important to increase spring limit and electrical conductivity at the second aging treatment. When the second aging temperature is set high, spring limit and electrical conductivity are increased but if the temperature is excessively high, the particles that have been already precipitated become coarse to enter an over-aged condition, leading to reduction of strength. Therefore, in the second aging treatment, a special care is necessary to maintain a lower temperature and a longer time than those of the conventional practice for recovering electrical conductivity and spring limit. This is to enhance the effect of both suppressing precipitation speed of the Co-containing alloys and effecting rearrangement of the dislocations. One example of the conditions for the second aging treatment is the temperature range of at least 100° C. but less than 350° C. for 1-48 hours, more preferably at least 200° C. but no more than 300° C. for 1-12 hours.

Right after the second aging treatment, the surface is a slightly oxidized even if the aging treatment is performed in an inert gas atmosphere, and has poor solder wettability. Thus, if solder wettability is required, pickling and/or grinding may be made. As for the pickling, any conventional means may be employed. Grinding may also be effected with any conventional means.

The Cu—Si—Co-based alloy according to the present invention can be worked into various wrought products such as plates, strips, tubes, rods and wires. Further, the Cu—Si—Co-based alloy according to the present invention can be used in electronic components such as lead frames, connectors, pins, terminals, relays, switches, foils for secondary batteries, etc.

EXAMPLES

Although the present invention will be explained in the following by examples and comparative examples, it should be understood that they are presented for better understanding of the invention and their advantages but are not intended to restrict the invention.

Copper alloys, each containing the respective elements as listed in Table 1 with the balance copper and impurities, were produced by melting them at 1300° C. and casting into ingots having a thickness of 30 mm. Next, the ingots were heated at 1000° C. for 3 hours, then hot rolled down to a thickness of 10 mm, and cooled rapidly after the termination of the hot rolling. Thereafter, each of their surfaces was scarfed down to 9 mm to remove the scales and then subjected to cold rolling to obtain a plate having a thickness of 0.13 mm. Then, the plate was subjected to solution treatment at 850-1050° C. for 120 seconds and then cooled with water. The cooling condition was such that the average cooling rate from the solution treatment temperature to 400° C. was 20° C./s. Thereafter, the first aging treatment was performed in an inert atmosphere under the each condition listed in Table 1. The temperature of the material in each stage was maintained within ±3° C. from the setting temperatures as listed in Table 1. Thereafter, the material was subjected to the cold rolling until 0.1 mm was reached. Finally, the second aging treatment was conducted at 300° C. for 3 hours to obtain each test specimen.

TABLE 1

| No Invention example | Co | Si | OTHERS |
|---|---|---|---|
| 1 | 1.3 | 0.3 | — |
| 2 | | | |
| 3 | | | |
| 4 | | | |
| 5 | | | |
| 6 | | | |
| 7 | | | |
| 8 | | | |
| 9 | | | |
| 10 | | | |
| 11 | | | |
| 12 | | | |
| 13 | | | |
| 14 | | | |
| 15 | | | |
| 16 | | | |
| 17 | | | |
| 18 | | | |
| 19 | | | |
| 20 | | | |
| 21 | | | |
| 22 | | | |
| 23 | | | |
| 24 | | | |
| 25 | | | |
| 26 | | | |
| 27 | | | |
| 28 | | | |
| 29 | | | |
| 30 | 0.5 | 0.1 | — |
| 31 | 0.5 | 0.1 | — |
| 32 | 0.5 | 0.10 | — |
| 33 | 0.5 | 0.10 | — |
| 34 | 1.0 | 0.20 | — |
| 35 | 1.0 | 0.24 | — |
| 36 | 1.0 | 0.30 | — |
| 37 | 2.0 | 0.50 | — |
| 38 | 2.0 | 0.50 | |
| 39 | 2.5 | 0.60 | — |
| 40 | 2.5 | 0.60 | — |
| 41 | 2.5 | 0.60 | — |
| 42 | 1.3 | 0.3 | 0.5Ni |
| 43 | | | 0.5Cr |
| 44 | | | 0.5Sn |
| 45 | | | 0.5Zn |
| 46 | | | 0.5Ag |
| 47 | | | 0.1Mg |
| 48 | | | 0.1Zr |
| 49 | | | 0.5Mn, 0.1Mg, 0.5Zn, 0.5Ag |
| 50 | | | 0.01.P, 0.01As, 0.01Sb, 0.01Be, 0.01B, 0.01Ti, 0.01Al, 0.01Fe, 0.01Zn |

| No COMPARATIVE Example | Co | Si | OTHERS |
|---|---|---|---|
| 1 | 1.3 | 0.3 | — |
| 2 | | | |

TABLE 1-continued

| | | | |
|---|---|---|---|
| 3 | | | |
| 4 | | | |
| 5 | | | |
| 6 | | | |
| 7 | | | |
| 8 | | | |
| 9 | | | |
| 10 | | | |
| 11 | | | |
| 12 | | | |
| 13 | | | |
| 14 | | | |
| 15 | | | |
| 16 | | | |
| 17 | | | |
| 18 | 0.3 | 0.07 | — |
| 19 | 0.5 | 0.10 | — |
| 20 | 1.0 | 0.20 | — |
| 21 | 1.0 | 0.24 | — |
| 22 | 1.0 | 0.30 | — |
| 23 | 2.5 | 0.60 | — |
| 24 | 3.0 | 0.71 | — |
| 25 | 1.3 | 0.3 | 0.5 Ni |
| 26 | | | 0.5 Cr |
| 27 | | | 0.5 Sn |
| 28 | | | 0.5 Zn |
| 29 | | | 0.5 Ag |
| 30 | | | 0.1 Mg |
| 31 | | | 0.1 Zr |
| 32 | | | 0.5 Mn, 0.1 Mg, 0.5 Zn, 0.5 Ag |
| 33 | | | 0.01. P, 0.01 As, 0.01 Sb, 0.01 Be, 0.01 B, 0.01 Ti, 0.01 Al, 0.01 Fe, 0.01 Zn |

| | 1st Aging Treatment | | | | | | | | | |
|---|---|---|---|---|---|---|---|---|---|---|
| No Invention example | 1st stage temp (° C.) | 1st → 2nd stage cool. rate (° C./min) | 2nd stage temp (° C.) | 1st → 2nd stage temp. dif. (° C.) | 2nd→ 3rd cool. rate (° C./min) | 3rd stage temp (° C.) | 2nd→ 3rd temp. dif. (° C.) | 1st stage time (hr) | 2nd stage time (hr) | 3rd stage time (hr) |
| 1 | 480 | 0.4 | 430 | 50 | 0.4 | 350 | 80 | 12 | 6 | 6 |
| 2 | | | | | | | | 12 | 6 | 30 |
| 3 | | | | | | | | 12 | 12 | 6 |
| 4 | | | | | | | | 12 | 12 | 30 |
| 5 | 510 | | 470 | 40 | | 400 | 70 | 6 | 6 | 6 |
| 6 | | | | | | | | 6 | 6 | 15 |
| 7 | | | | | | | | 6 | 12 | 6 |
| 8 | | | | | | | | 6 | 12 | 15 |
| 9 | 540 | | 460 | 80 | | 300 | 160 | 6 | 6 | 6 |
| 10 | | | | | | 380 | 80 | 3 | 6 | 6 |
| 11 | | | | | | | | 3 | 6 | 30 |
| 12 | | | | | | | | 6 | 1 | 6 |
| 13 | | | | | | | | 6 | 6 | 4 |
| 14 | | | | | | | | 6 | 6 | 6 |
| 15 | | | | | | | | 6 | 6 | 30 |
| 16 | | | | | | | | 6 | 12 | 6 |
| 17 | | | | | | | | 6 | 12 | 10 |
| 18 | | | | | | | | 6 | 12 | 30 |
| 19 | | | | | | 430 | 30 | 6 | 12 | 6 |
| 20 | | | 500 | 40 | | 400 | 100 | 3 | 6 | 6 |
| 21 | | | | | | | | 3 | 6 | 15 |
| 22 | | | | | | | | 6 | 6 | 6 |
| 23 | | | | | | | | 6 | 6 | 15 |
| 24 | 580 | | 530 | 50 | | 430 | 100 | 1 | 3 | 4 |
| 25 | | | | | | | | 1 | 3 | 15 |
| 26 | | | | | | | | 1 | 6 | 4 |
| 27 | | | | | | | | 1 | 6 | 15 |
| 28 | 540 | 0.4 | 460 | 80 | 0.1 | 380 | 80 | 3 | 6 | 6 |
| 29 | | 0.1 | | | 0.4 | | | 3 | 6 | 6 |
| 30 | 580 | 0.4 | 530 | 50 | 0.4 | 430 | 100 | 1 | 3 | 4 |
| 31 | 540 | 0.4 | 460 | 80 | 0.4 | 380 | 80 | 6 | 12 | 30 |
| 32 | 540 | | 460 | 80 | | 380 | 80 | 3 | 6 | 6 |
| 33 | 510 | | 470 | 40 | | 400 | 70 | 6 | 6 | 6 |
| 34 | 540 | | 460 | 80 | | 380 | 80 | 3 | 6 | 6 |
| 35 | | | | | | | | | | |
| 36 | | | | | | | | | | |
| 37 | 510 | | 470 | 40 | | 400 | 70 | 6 | 6 | 15 |

TABLE 1-continued

| | | | | | | | | |
|---|---|---|---|---|---|---|---|---|
| 38 | 510 | 470 | 40 | 400 | 70 | 6 | 6 | 4 |
| 39 | 510 | 470 | 40 | 400 | 70 | 6 | 6 | 15 |
| 40 | 540 | 460 | 80 | 380 | 80 | 3 | 6 | 6 |
| 41 | 580 | 530 | 50 | 430 | 100 | 1 | 3 | 4 |
| 42 | 540 | 460 | 80 | 380 | 80 | 3 | 6 | 6 |
| 43 | | | | | | | | |
| 44 | | | | | | | | |
| 45 | | | | | | | | |
| 46 | | | | | | | | |
| 47 | | | | | | | | |
| 48 | | | | | | | | |
| 49 | | | | | | | | |
| 50 | | | | | | | | |

| | 1st Aging Treatment | | | | | | | | | |
|---|---|---|---|---|---|---|---|---|---|---|
| No COMP. EXAMPLE | 1st stage temp (° C.) | 1st → 2nd stage cool. rate (° C./mon) | 2nd stage temp (° C.) | 1st → 2nd stage temp. dif. (° C.) | 2nd→ 3rd stage cool. rate (° C./mon) | 3rd stage temp (° C.) | 2nd→ 3rd stage temp. dif. (° C.) | 1st stage time (hr) | 2nd stage time (hr) | 3rd stage time (hr) |
| 1 | 450 | 0.4 | 430 | 20 | 0.4 | 350 | 80 | 6 | 6 | 6 |
| 2 | 480 | 0.4 | 430 | 50 | 0.4 | 350 | 80 | 12 | 6 | 1 |
| 3 | 540 | 0.4 | 375 | 165 | 0.4 | 350 | 25 | 1 | 1 | 6 |
| 4 | 540 | 0.4 | 460 | 80 | 0.4 | 250 | 210 | 1 | 1 | 6 |
| 5 | 540 | 0.4 | 460 | 80 | 0.4 | 380 | 80 | 0.5 | 6 | 6 |
| 6 | 540 | 0.4 | 460 | 80 | 0.4 | 380 | 80 | 1 | 0.5 | 6 |
| 7 | 540 | — | — | — | — | — | — | 6 | none | none |
| 8 | 540 | 0.4 | 460 | 80 | — | — | — | 6 | 6 | none |
| 9 | 540 | 0.4 | 460 | 80 | 0.4 | 380 | 80 | 6 | 6 | 1 |
| 10 | 540 | 0.4 | 460 | 80 | 0.4 | 380 | 80 | 6 | 50 | 6 |
| 11 | 540 | 0.4 | 460 | 80 | 0.4 | 380 | 80 | 15 | 6 | 6 |
| 12 | 540 | 0.4 | 460 | 80 | 0.4 | 430 | 30 | 6 | 12 | 100 |
| 13 | 540 | 0.4 | 460 | 80 | 0.4 | 450 | 10 | 6 | 12 | 30 |
| 14 | 540 | 0.4 | 535 | 5 | 0.4 | 425 | 110 | 6 | 12 | 6 |
| 15 | 600 | 0.4 | 530 | 70 | 0.4 | 430 | 100 | 6 | 6 | 6 |
| 16 | 540 | 0.4 | 460 | 80 | 0.02 | 380 | 80 | 3 | 6 | 6 |
| 17 | | 0.02 | | | 0.4 | | | 3 | 6 | 6 |
| 18 | 540 | 0.4 | 460 | 80 | 0.4 | 380 | 80 | 3 | 6 | 6 |
| 19 | 540 | 0.4 | 460 | 80 | — | — | — | 3 | 6 | none |
| 20 | 540 | 0.4 | 460 | 80 | — | — | — | 3 | 6 | |
| 21 | 540 | 0.4 | 460 | 80 | — | — | — | 3 | 6 | |
| 22 | 540 | 0.4 | 460 | 80 | — | — | — | 3 | 6 | |
| 23 | 540 | 0 4 | 460 | 80 | — | — | — | 3 | 6 | |
| 24 | 540 | 0.4 | 460 | 80 | 0.4 | 380 | 80 | 3 | 6 | 6 |
| 25 | 540 | 0.4 | 460 | 80 | — | — | — | 3 | 6 | none |
| 26 | 540 | 0.4 | 460 | 80 | — | — | — | 3 | 6 | |
| 27 | 540 | 0.4 | 460 | 80 | — | — | — | 3 | 6 | |
| 28 | 540 | 0.4 | 460 | 80 | — | — | — | 3 | 6 | |
| 29 | 540 | 0.4 | 460 | 80 | — | — | — | 3 | 6 | |
| 30 | 540 | 0.4 | 460 | 80 | — | — | — | 3 | 6 | |
| 31 | 540 | 0.4 | 460 | 80 | — | — | — | 3 | 6 | |
| 32 | 540 | 0.4 | 460 | 80 | — | — | — | 3 | 6 | |
| 33 | 540 | 0.4 | 460 | 80 | — | — | — | 3 | 6 | |

The properties of alloys of the respective specimens obtained in this way were measured according to the following procedure.

With respect to the strength, 0.2% yield strength (YS: MPa) was measured according to JIS Z2241 by conducting the tensile test in the direction parallel to the rolling direction.

As for the electrical conductivity (EC: % IACS), the volume resistivity was measured using a double bridge.

The spring limit was measured according to JIS H3130 wherein repetitive deflection test were performed and the surface maximum stress was measured from the bending moment by the remaining permanent distortion.

The peak height ratio at β angle of 90° was measured according to the method explained earlier, using the X ray diffractometer of the type RINT-2500V manufactured by Rigaku Corporation.

The test results for respective test pieces are listed in Table 2.

TABLE 2

| No Invention example | YS (MPa) | EC (% IACS) | Kb (MPa) | Peak height ratio at β angle of 90° |
|---|---|---|---|---|
| 1 | 647 | 64 | 402 | 3.4 |
| 2 | 644 | 67 | 390 | 3.1 |
| 3 | 642 | 65 | 395 | 3.3 |
| 4 | 644 | 67 | 398 | 3.3 |
| 5 | 681 | 65 | 435 | 3.8 |
| 6 | 674 | 66 | 421 | 3.7 |
| 7 | 670 | 66 | 410 | 3.5 |
| 8 | 663 | 68 | 404 | 3.3 |
| 9 | 674 | 65 | 426 | 3.9 |
| 10 | 661 | 66 | 432 | 3.9 |
| 11 | 660 | 68 | 418 | 3.7 |
| 12 | 654 | 67 | 404 | 3.5 |
| 13 | 655 | 68 | 389 | 3.5 |
| 14 | 652 | 68 | 393 | 3.0 |

TABLE 2-continued

| | | | | |
|---|---|---|---|---|
| 15 | 647 | 69 | 401 | 3.4 |
| 16 | 641 | 69 | 384 | 2.9 |
| 17 | 631 | 69 | 390 | 3.0 |
| 18 | 628 | 70 | 395 | 3.0 |
| 19 | 639 | 69 | 387 | 3.0 |
| 20 | 665 | 66 | 418 | 3.8 |
| 21 | 657 | 68 | 416 | 3.6 |
| 22 | 642 | 68 | 401 | 3.4 |
| 23 | 633 | 70 | 379 | 2.8 |
| 24 | 630 | 70 | 371 | 2.6 |
| 25 | 626 | 72 | 375 | 2.7 |
| 26 | 618 | 71 | 370 | 2.6 |
| 27 | 617 | 71 | 369 | 2.6 |
| 28 | 670 | 67 | 406 | 3.4 |
| 29 | 641 | 65 | 388 | 3.1 |
| 30 | 501 | 74 | 337 | 2.6 |
| 31 | 525 | 75 | 401 | 3.1 |
| 32 | 561 | 73 | 353 | 2.8 |
| 33 | 584 | 70 | 367 | 2.8 |
| 34 | 625 | 68 | 374 | 2.8 |
| 35 | 651 | 68 | 401 | 3.2 |
| 36 | 612 | 65 | 366 | 2.7 |
| 37 | 738 | 62 | 488 | 3.5 |
| 38 | 751 | 59 | 412 | 2.7 |
| 39 | 758 | 56 | 512 | 3.2 |
| 40 | 731 | 58 | 486 | 3.8 |
| 41 | 683 | 59 | 431 | 2.6 |
| 42 | 742 | 60 | 453 | 3.1 |
| 43 | 676 | 67 | 436 | 3.7 |
| 44 | 689 | 62 | 447 | 3.6 |
| 45 | 668 | 63 | 418 | 2.8 |
| 46 | 679 | 67 | 419 | 2.8 |
| 47 | 690 | 62 | 427 | 3.0 |
| 48 | 684 | 68 | 430 | 4.0 |
| 49 | 693 | 61 | 452 | 3.7 |
| 50 | 677 | 66 | 433 | 3.5 |

| No Comp. Example | YS (MPa) | EC (% IACS) | Kb | Peak height ratio at β angle of 90° |
|---|---|---|---|---|
| 1 | 590 | 60 | 347 | 2.2 |
| 2 | 642 | 62 | 341 | 2.1 |
| 3 | 595 | 60 | 350 | 2.3 |
| 4 | 593 | 60 | 346 | 2.1 |
| 5 | 589 | 59 | 340 | 2.0 |
| 6 | 584 | 57 | 341 | 2.1 |
| 7 | 647 | 61 | 314 | 1.7 |
| 8 | 654 | 64 | 334 | 1.9 |
| 9 | 651 | 66 | 341 | 2.1 |
| 10 | 551 | 72 | 289 | 1.3 |
| 11 | 582 | 70 | 334 | 2.0 |
| 12 | 598 | 75 | 342 | 2.4 |
| 13 | 588 | 70 | 342 | 2.1 |
| 14 | 583 | 71 | 334 | 2.1 |
| 15 | 428 | 73 | 266 | 1.3 |
| 16 | 589 | 74 | 333 | 2.0 |
| 17 | 584 | 73 | 332 | 1.9 |
| 18 | 488 | 75 | 323 | 2.5 |
| 19 | 566 | 71 | 264 | 1.6 |
| 20 | 619 | 66 | 305 | 1.5 |
| 21 | 634 | 65 | 316 | 1.6 |
| 22 | 602 | 62 | 285 | 1.5 |
| 23 | 712 | 56 | 387 | 2.3 |
| 24 | 732 | 58 | 496 | 3.8 |
| 25 | 731 | 58 | 366 | 2.2 |
| 26 | 661 | 65 | 350 | 2.3 |
| 27 | 673 | 59 | 369 | 2.2 |
| 28 | 668 | 60 | 362 | 2.3 |
| 29 | 669 | 66 | 363 | 2.1 |
| 30 | 660 | 61 | 366 | 2.1 |
| 31 | 662 | 65 | 354 | 2.4 |
| 32 | 671 | 60 | 355 | 2.2 |
| 33 | 668 | 62 | 365 | 2.3 |

The inventive examples having the peak height ratio at β angle of 90° of at least 2.5 showed a good balance among strength, electrical conductivity and spring limit.

Comparative Example 8, Comparative Examples 19-23, Comparative Examples 25-33 are examples in which the first aging was conducted in two stage aging.

Comparative Example 7 is an example in which the first aging was conducted in one step aging.

Comparative Example 5 is an example in which the first stage aging was short.

Comparative Example 11 is an example in which the first stage aging time was long.

Comparative Example 1 is an example in which the aging temperature in the first stage was low.

Comparative Example 15 is an example in which the aging temperature in the first stage was high.

Comparative Example 6 is an example in which the aging time in the second stage was short.

Comparative Example 10 is an example in which the aging time in the second stage was long.

Comparative Example 3 is an example in which the aging temperature in the second stage was low.

Comparative Example 14 is an example in which the aging temperature in the second stage was high.

Comparative Examples 2 and 9 are examples in which the aging time in the third stage was short.

Comparative Example 12 is an example in which the aging time in the third stage was long.

Comparative Example 4 is an example in which the aging temperature in the third stage was low.

Comparative Example 13 is an example in which the aging temperature in the third stage was high.

Comparative Example 16 is an example in which the cooling rate from the second stage to the third step was low.

Comparative Example 17 is an example in which the cooling rate from the first stage to the second stage was low.

These Comparative Examples had the peak height ratio at β angle of 90° less than 2.5 and were inferior to Examples in the balance among strength, electrical conductivity and spring limit.

In Comparative Example 18, the peak height ratio at β angle of 90° was at least 2.5 but due to the lower Co and Si concentrations, the balance among strength, electrical conductivity and spring limit was inferior to the examples of the present invention.

As for Comparative Example 24, the peak height ratio at the β angle of 90° was at least 2.5, and has a good balance among strength, electrical conductivity and spring limit, but the properties are comparative to Example 40 even though the Co concentration was increased by 0.5% as compared with Example 40. Thus, there arises a problem in the aspect of the manufacturing cost.

Figure 2:
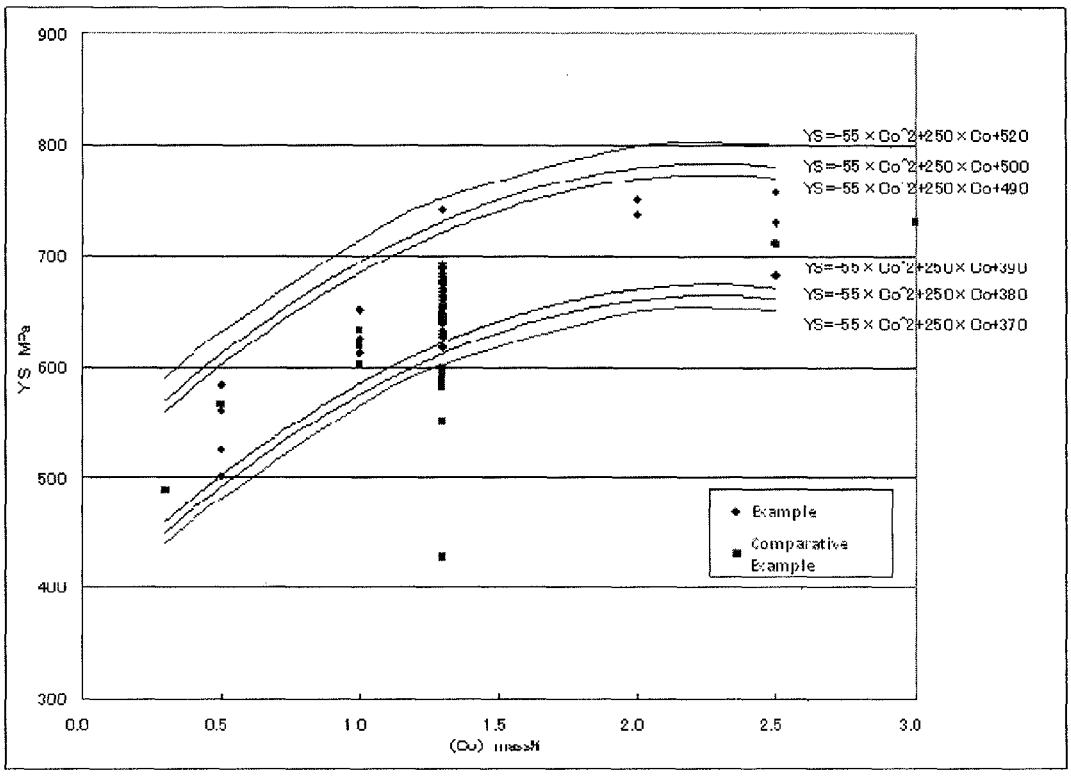
FIG. 2 is a graph wherein the examples and comparative examples are plotted with Co mass % as the x axis and YS as the y axis.

With respect to these examples, the relations are plotted with:

YS as x-axis, and Kb as y-axis in FIG. 1;

Co mass % as x-axis, and YS as y-axis in FIG. 2; and

Figure 3:
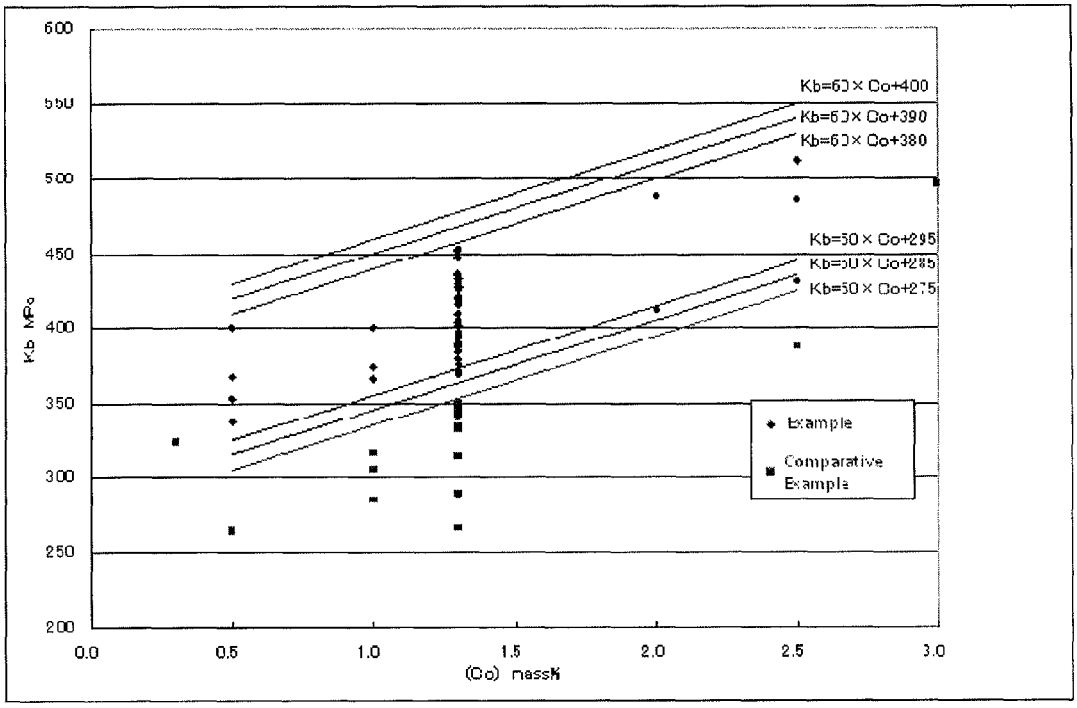
FIG. 3 is a graph wherein the examples and comparative examples are plotted with Co mass % as the x axis and Kb as the y axis.

Co mass % (Co) as x-axis, and Kb as y axis in FIG. 3.

From FIG. 1, it was ascertained that the copper alloys of the inventive examples satisfied the relationship:

$$0.43\times YS+215\geq Kb\geq 0.23\times YS+215;$$

From FIG. 2, it was ascertained the copper alloys of the inventive examples were able to satisfy the relationship:

$$-55\times(\text{Co concentration})^2+250\times(\text{Co concentration})+520\geq YS\geq -55\times(\text{Co concentration})^2+250\times(\text{Co concentration})+370;\text{ and} \quad \text{Formula a)}$$

From FIG. 3, it was ascertained that the copper alloys of the inventive examples were able to satisfy the relationship:

$$60\times(\text{Co concentration})+400\geq Kb\geq 60\times(\text{Co concentration})+275. \quad \text{Formula b)}$$

The invention claimed is:

1. A copper alloy for electronic materials, comprising 0.5-2.5 mass % of Co, 0.1-0.7 mass % of Si, optionally containing less than 1.0 mass % of Ni, further optionally containing at most 2.0 mass % in total of at least one selected from the group consisting of Cr, Mg, P, As, Sb, Be, B, Mn, Sn, Ti, Zr, Al, Fe, Zn, and Ag, the balance Cu and inevitable impurities, wherein, from a result obtained from measurement of an X ray diffraction pole figure, using a rolled surface as a reference plane, a peak height at β angle of 90° among diffraction peaks in {111} Cu plane with respect to {200} Cu plane by β scanning at α=35° is at least 2.5 times that of a standard copper powder, wherein the copper alloy satisfies the following formula:

$$60\times(\text{Co concentration})+400\geq Kb\geq 60\times(\text{Co concentration})+275, \quad \text{Formula b:}$$

wherein in the formula, the unit of Co concentration is mass % and Kb is spring limit.

2. The copper alloy according to claim 1, wherein the copper alloy satisfies the following formula:

$$-55\times(\text{Co concentration})+250\times(\text{Co concentration})+520\geq YS\geq -55\times\text{Co concentration})^2+250\times(\text{Co concentration})+370, \quad \text{Formula a:}$$

wherein in the formula, the unit of Co concentration is mass % and YS is 0.2% yield strength.

3. The copper alloy according to claim 1, wherein YS is at least 500 MPa and Kb and YS satisfy the following relationship:

$$0.43\times YS+215\geq Kb\geq 0.23\times YS+215, \quad \text{Formula c:}$$

wherein YS is 0.2% yield strength, and Kb is spring limit.

4. The copper alloy according to claim 1, wherein the Co to Si mass concentration ratio (Co/Si) satisfies the following relationship: $3\leq Co/Si\leq 5$.

5. A method for producing a copper alloy according to claim 1, which comprises:

step 1 of melting and casting an ingot of copper alloy having a composition according to claim 1;

step 2 of heating the ingot at 900° C.-1050° C. for at least 1 hour, and thereafter subjecting it to a hot rolling;

step 3 of cold rolling;

step 4 of conducting solution treatment at 850-1050° C. and then cooling with an average cooling rate to 400° C. of at least 10° C./sec;

first aging step 5 comprising three-stage aging, said three-stage aging comprising a first stage of heating the material at 480° C.-580° C. for 1-12 hours, then a second stage of heating the material at 430-530° C. for 1-12 hours, and then a third stage of heating the material at 300-430° C. for 4-30 hours, wherein the cooling rates from the first stage to the second stage and from the second stage to the third stage are at least 0.1° C./min respectively, and the temperature difference between the first stage and the second stage is 20-80° C., and the temperature difference between the second stage to the third stage is 20-180° C.;

step 6 of cold rolling; and second aging step 7 of heating to at least 100° C. but less than 350° C. for 1-48 hours.

6. A wrought copper product made of a copper alloy according to claim 1.

7. An electronic component provided with the copper alloy according to claim 1.

* * * * *